US005542961A

United States Patent [19]

Swei et al.

[11] Patent Number: 5,542,961

[45] Date of Patent: Aug. 6, 1996

[54] DIELECTRIC CURING

[75] Inventors: Gwo S. Swei, East Amherst, N.Y.; Nicolas Avril, Merignac, France; Jony Wijaya, Amherst, N.Y.

[73] Assignee: Norton Company, Worcester, Mass.

[21] Appl. No.: 412,485

[22] Filed: Mar. 28, 1995

[51] Int. Cl.[6] ..... B24D 3/34

[52] U.S. Cl. ..... 51/295; 51/298; 51/307

[58] Field of Search ..... 51/293, 298, 307, 51/295; 427/591

[56] References Cited

U.S. PATENT DOCUMENTS 4,150,514 4/1979 Douglass ..... 51/298

5,464,665 11/1995 Anthony et al. ..... 427/570

*Primary Examiner*—Deborah Jones

*Attorney, Agent, or Firm*—David Bennett

[57] ABSTRACT

Use of dielectric heating to cure a thermosettable resin component of a binder formulation used to secure abrasive particles to a backing in a coated abrasive greatly accelerates the production process.

10 Claims, No Drawings

DIELECTRIC CURING

BACKGROUND OF THE INVENTION

This invention relates to the production of coated abrasives and specifically to the curing of resin coats by which an abrasive grit is adhered to a backing material in the production of coated abrasives.

In a typical coated abrasive manufacturing process a backing material, which has frequently been treated with a filler coating to make it a better substrate for the application of a binder solution, is coated with a binder resin formulation called a maker coat. Abrasive particles are applied to the coated backing which is then treated to cure the maker coat at least to the extent necessary to hold the particles firmly in place. The coated product thereafter is often given a further binder coat, usually called a size coat, that improves the strength of the bond holding the abrasive particles to the backing. This size coat can also act as a vehicle for the application of a grinding aid or other additive to modify the grinding performance of the coated abrasive. The size coat is then cured.

The resins most frequently used as vehicles for maker and size coats have typically been based on modified or unmodified phenolic resins. While other binders have been suggested, they are subject to problems of control, expense and environmental impact such that they are not universally attractive.

While these alternative binders have their problems, there are also significant problems arising from the use of phenolic resins in such applications.

The first problem arises from the fact that they are used in the form of aqueous dispersions containing about 30–40% of water which must be removed before cure can occur. This drying process, if performed too quickly or at too high a temperature, can result in blisters and bubbles being formed in the bond material which severely reduce the bond strength. Thus typically the drying process is protracted and costly but must be essentially complete before curing can begin.

The phenolic bonding resins when first applied, are lightly or not at all cross-linked. During cure they are increasingly cross-linked and become more and more rigid as a result. The cure process is advanced to different degrees at the various stages of the manufacture of a coated abrasive. The initial cure of the maker coat is advanced only to the extent necessary to ensure that it remains dimensionally stable and holds the abrasive grits in place during subsequent "post-cure" processing. The backing with the abrasive grains held by a partially cured maker coat is then frequently provided with a size coat that is most often, but not essentially, chemically similar to the maker coat. This provides most of the grain retention function. This size coat must be dried and partially cured till it can be safely rolled without the overlying laps sticking to one another. The rolls are then conventionally placed in a controlled temperature environment to complete the cure. Because the rolls develop a temperature gradient from the outside to the core, care and time must be taken to ensure that this gradient is minimized to ensure uniformity of cure throughout the roll. This can take days to accomplish and implies that a huge amount of "work-in-progress" inventory is established. This is a source of great inefficiencies.

The problems in adequately and uniformly curing the binder resins derive in part from the nature of the cure process and the time needed to take the resin to the desired degree of cross-linking. In order to ensure the uniformity of the cure, the time is frequently measured in hours rather than minutes. Typically the drying and partial cure of the maker and size coats is carried out in ovens while draped over slats so as to hang in folds. These ovens, which are often referred to as "festoon ovens", have to be very large to accommodate the hanging folds and need to be in the form of temperature controlled zones held at temperatures appropriate to drying or curing operations. The curing zones are held at high temperatures for quite long periods to ensure controlled cure to the correct extent. Moreover such ovens are required not only to dry and partially cure the maker coat but also to dry and partially cure the size coat that is typically applied over it. Only after the correct level of cure of the top coating layer, (usually the size layer), has been obtained are the sheets rolled up and "post-cured" to the final desired level in that form. Drying and curing is therefore a very expensive operation in the production of coated abrasives.

Moreover the use of festoon ovens can lead to localized defects at the points where the sheets pass over the supporting slats. Stagnant air spots inside the oven between the folds can also lead to uneven heating of the sheets and uneven cure profiles across the sheets.

The present invention provides a novel way of heat-curing thermoset resins used in the manufacture of coated abrasives. This technique can readily be controlled, requires a fraction of the time to achieve the same degree of cure and potentially eliminates the need for festoon ovens altogether. This process is therefore capable of radically speeding up the production process and of significantly reducing the costs involved.

DESCRIPTION OF THE INVENTION

The present invention provides a process for the production of a coated abrasive comprising abrasive particles adhered to a backing material by one or more binder coats comprising a heat-curable resin, wherein the binder coats are cured by dielectric heating.

The term binder coat is used herein to cover maker, size and, where used supersize coats. The unifying feature is that each contains a thermoset resin component that needs to be cured in the course of producing the coated abrasive final product.

The term "dielectric heating" refers to heating by means of radio frequency or microwave frequency waves which directly excite polar components within the material heated thereby generating heat which is transmitted to the rest of the material. Radio frequency heating is known in general and operates on frequencies from about 1 to about 100 MHz. In the United States, the Federal Communications Commission, (FCC), licenses the unshielded use of assigned radio frequencies such as 13, 27 and 40 MHz, but other frequencies can be used provided the equipment is shielded so that the use of these frequencies does not interfere with other equipment that operates in the same range. Microwave heating is of course very well known in, for example, cooking in which the microwaves excite water and other polar molecules in the foodstuff and produces uniform and rapid cooking. Microwaves usually operate in a somewhat higher range of frequencies of from about 500 to about 15000 MHz. For example, the FCC has assigned 914 and 2450 MHz for use in microwave heating in unshielded environments.

In coated abrasive application the binder resins used are commonly thermoset resins in an aqueous medium. This makes them ideal to be cured by use of dielectric heating because of the polar nature of water. The dielectric frequencies used will speedily heat up the water uniformly and the heat will initiate the thermosetting reaction as the water is removed by evaporation. However as more cross-linking occurs, the effective loss factor (E") is reduced as the molecules become less mobile and there is less capability for interaction with the dielectric heating. The efficiency of heating is therefore reduced. As a result it is desirable to incorporate into the binder an inert material that is a polar material and will act as a means of conveying heat to the material to complete the cure to the required degree.

While it is possible to use dielectric heating exclusively to bring about the cure of a resin binder, it is often desirable to use dielectric heating to complete cure of a resin binder that has been dried and partially cured by other cure techniques. In one form of such an operation a semi-cured coated abrasive material is rolled into a "jumbo" roll and is then subjected to the dielectric cure. The dielectric heating technique is particularly suited to heating a jumbo since it lends itself to a much higher degree of uniformity of heating throughout the roll and the heating is essentially instantaneous.

Alternatively or perhaps additionally, dielectric cure can be used to cure a binder resin layer that has been dried by other techniques. In such a process the sheet having a resin layer from which at least the greater part, and preferably substantially all, of the water has been removed is passed "in-line" through a dielectric heating device in which the cure is advanced to the desired degree. This technique is particularly preferred when associated with the use of high efficiency directed hot air driers that are capable of eliminating the water from a phenolic resin binder to render it non-tacky in a matter of minutes. Such a dryer may incorporate a plurality of directed high velocity hot air jets. The air flow and the temperatures are preferably profiled so as to ensure gradual uniform heating and water removal while minimizing turbulence and disruption of the surface of the sheet. While high pressure air removes the water, the sheet may be carried on low pressure hot air bearings to minimize physical contact with hard surfaces during the drying phases. This cooperation permits the design of an in-line process that does not need festoon ovens with their attendant problems as discussed above.

In dielectric heating the power dissipated, P, is determined by the following equation:

$$P=5.56\times V\times f\times E^2\times E''\times 10^{-11} \text{ watts}$$

where V is the volume of the material in cubic meters;

f is the frequency in Hz;

E is the electric field strength in volts/m, that is the applied voltage across the plates divided by their separation; and E" is the "effective loss factor" that varies with the material. The effective loss factor consists of losses due to polarization and conductivity such that:

$$\begin{aligned} E'' &= E''_d(w)+E''_e(w)+E''_a(w)+E''_{mw}(w)+S/E_o\cdot w \text{ and} \\ &= E''(w)+S/E_o\cdot w \end{aligned}$$

In the above equations the subscripts "d" "e" "a" and "mw" refer to dipolar, electronic, atomic and Maxwell-Wagner polarization losses respectively. The last term represents the loss due to conductivity and in that term "S" is the conductivity of the material; "E" is the dielectric constant of free space and "w" is the angular frequency. The loss mechanisms that are most important in the frequency band of industrial high frequency heating are the dipolar, Maxwell-Wagner and the d.c. conductivity.

Each material in the coated abrasive formulation that is being heated will have its own heating rate which will be determined by the dielectric loss factor of the material. For most non-polar materials for which E" is typically very low, this heating rate will be very small. However if materials are added that have a very high value for E" or conductivity, then they will rapidly heat up and transfer the heat to the mixture and specifically the thermosettable resin thereby advancing the cure of the resin. Such materials are referred to hereafter as "dielectric fillers". Because the degree of cure of thermosettable resins is typically a temperature dependant function, and since, given uniform distribution of the dielectric filler throughout the coated abrasive and providing there is negligible heat loss at the surface, the temperature reached will be the same at the surface as in the interior. It is therefore possible to monitor the surface temperature to control the degree of cure as desired. Moreover, because the heating is essentially instant, the dielectric heating can be switched on and off to keep the cure temperature essentially constant in response to a simple surface temperature sensor.

Thus in one embodiment of the invention, it is possible to use dielectric heating, particularly in conjunction with a dielectric filler, to dry and cure, or more preferably to simply cure a dried maker resin "on-line" to the required degree, (so that the coated abrasive sheet being produced can be further treated and so that the abrasive grains will not easily become detached), and subject it directly to a size coat treatment without first experiencing a prolonged residence in a festoon oven. Indeed the size coat treatment can be applied essentially "in-line". This coat can then be dried and partially cured using similar techniques to ensure the resin is no longer sticky and then rolled up into large rolls known as "jumbos" which may then be unrolled and subjected to a final dielectric cure operation before being rolled again. It is possible in some circumstances to perform all the final cure in the rolled-up form. This would be impossible using conventional direct heat cure methods because of the temperature gradient, (and therefore extent of cure variation), that inevitably develops within the roll unless uneconomically slow rates of heating are adopted.

By eliminating the festoon oven Curing requirement, the time needed for producing a completely cured coated abrasive roll ready for conversion into commercial coated abrasive materials such as belts or discs can be significantly reduced from 10 hours to a matter of minutes. Moreover the uniformity of the product is greatly enhanced and the reject material associated with the parts of the sheet in contact with the slats used to support the folds in the festoon ovens is completely eliminated.

The thermoset resin used in the binder formulation is usually a phenolic resin and the phenolic resin most frequently selected is a resole though novolak resin can also be used in some circumstances. Other thermoset resins such as melamine/formaldehyde, urea/formaldehyde, epoxy resins such as epoxy-novolaks, thermosetting polyesters, and the like may also be used.

The dielectric fillers added to provide the increased E" factor may vary widely but some are particularly preferred because they can serve a dual function. For example some materials can act also as an inert filler to reduce the amount of resin required and some act as grinding aids to enable the abrasive grits to cut more effectively or more coolly. Some other materials can act as anti-blocking additives to reduce any buildup of abraded material help by static charges on the surface of the coated abrasive.

There are two types of dielectric fillers:

1. Fillers that increase the E" of the system by conductivity and Maxwell-Wagner polarization mechanisms. These fillers are conductive in nature and include for example carbon black, graphite and conductive quaternary ammonium salts; and 2. Fillers that increase the E" of the system by dipole polarization mechanisms. Such fillers have a high E" value which is understood to be a value in excess of about 2, such as from about 2 to about 900, and preferably from about 10 to about 300.

To demonstrate the effect of various filler materials, 20 ml of a liquid epoxy resin, (DGEBA-EPON 825, Epon is a registered Trademark of Shell Chemical Company), without a curing agent was mixed 5% by weight of filler and the sample was placed between parallel plates electrodes, (38 mm separation), for 20 seconds. The initial and final temperatures were measured using a thermometer. The results obtained with seven fillers is shown in Table 1 below.

TABLE 1

| FILLER | INITIAL TEMP. | FINAL TEMP. |
|---|---|---|
| NONE | 29° C. | 68° C. |
| GRAPHITE | 28° C. | 109° C. |
| QUATERNARY AMM. SALT | 29° C. | 80° C. |
| ALUMINA | 28° C. | 66° C. |
| SILICON CARBIDE | 28° C. | 65° C. |
| CALCIUM CARBONATE | 28° C. | 67° C. |
| CARBON BLACK | 29° C. | 67° C. |
| $KBF_4$ | 28° C. | 67° C. |

From the data on Table 1 it would appear that only graphite and the quaternary ammonium salt were effective. When the same resin/filler mixtures are dielectrically heated with a curing agent, (diethylenetriamine) present in the mixture, similar results were obtained though the other fillers appeared to increase the final temperature marginally. In this series of tests the resin system with blended-in filler, (10 wt %), was allowed to cure at room temperature for 15 hours before being radio-frequency heated between parallel plates with a 25.4. mm gap for 30 seconds. Again the initial and final temperatures were measured though this time using an optical pyrometer. The results appear in Table 2.

TABLE 2

| FILLER | INITIAL TEMP. | FINAL TEMP. |
|---|---|---|
| NONE | 24° C. | 60.5° C. |
| QUATERNARY AMM. SALT | 24° C. | 179° C. |
| SILICON CARBIDE | 24° C. | 63.9° C. |
| BARIUM TITANATE | 24° C. | 67.2° C. |
| CARBON BLACK | 24° C. | 122° C. |
| $KBF_4$ | 24° C. | 65° C. |

The incorporation of a filler can also have a very significant effect on the dielectric loss of a resin. Clearly the greater the dielectric loss the more susceptible to dielectric cure the mixture becomes. To illustrate this point 10 wt % of various fillers was incorporated into an acrylic resin system, (Ebacryl 616, available under that trade name from UCB Radcure Inc. with 1% of a photoinitiator, CGI 1700, available from Ciba-Geigy). The mixture was cured using UV radiation. Each sample was subjected, at a temperature of 115° C. to a dielectric field at two different levels and the Dielectric Loss (E") was measured. The results appear in Table 3 below.

TABLE 3

| FILLER | E" at 0.1 Hz | E" at 100,000 Hz |
|---|---|---|
| NONE | 3.5 | 0.02 |
| SILICON CARBIDE | 19.6 | 0.05 |
| BARIUM TITANATE | 7.4 | 0.04 |
| GRAPHITE | 20.4 | 0.06 |
| $KBF_4$ | 20.7 | 0.03 |

The loss factor, (E"), of barium titanate is 55 at a frequency of 100 MHz. By contrast the E" of a phenolic resin under the same conditions is about 0.04 to about 0.16. It will be appreciated therefore that the amount of heating directly absorbed by the resin as a result of exposure to the dielectric heating, (as opposed to heating from adjacent dielectric filler particles), is very small.

The amount of the dielectric filler that is added may vary according to the E" factor and according to the amount that can be tolerated in the formulation without interfering with the binding function of the resin. Generally however the amount can vary from about 1 to about 70 and preferably from about 10 to about 50% by weight of a binder formulation where the E" factor of the dielectric filler is above 2. Of course the higher the E" factor, the less is required for the purpose of heating. However to achieve the purpose stated above, the dielectric filler should be evenly distributed throughout the binder formulation. The form of the dielectric filler is usually that of a fine powder but in some cases a filler in fine filamentary form may be advantageous.

The coated abrasives produced by the process of the invention can use any type of abrasive grit or mixtures of such grits in any desired grit size. Some grits have some advantage for use in the process of the invention since they have a E" factor higher than that of the resin and can therefore actually aid in the curing process. This is usually a minor contribution however and the nature of the grit is likewise usually a minor consideration. Grits such as alumina, (both the fused and sintered varieties), alumina/zirconia abrasives, silicon carbide, silicon nitride and the like can be used. Superabrasives such as diamond or cubic boron nitride can also be used but the cost of such materials usually requires that they be used, (if at all), in combination with other less expensive abrasive materials.

The nature of the backing can be chosen from a wide range of materials including woven and non-woven fabrics, including stitch-bonded fabrics, made from natural or synthetic fibers. Paper or plastics materials of suitably heavy weight may also be used in some limited applications.

DESCRIPTION OF PREFERRED EMOBODIMENTS

The invention is now further described with reference to the following Examples which are for the purpose of illustration only and should not be taken as implying any necessary limitation on the essential scope of the invention.

EXAMPLE 1

In this Example two coated abrasives were prepared. Both employed a paper backing, (170 lb Arjomari Paper), and conventional phenolic resins in both maker and size coats. In each case the maker coat contained 52% of a phenolic resin formulation, 6.5% of a latex rubber and 42% of a calcium carbonate filler, all proportions being by weight. The maker coat was applied at 3.5 lb/ream, (51.89 g/m$^2$). (A "ream" is an area measurement corresponding to 36.67 square yards or 30.66 square meters).

The abrasive that was UP-coated over the maker coat of each was a conventional fused aluminum oxide and the application rate was 5 lb/ream, (74.13 g/m$^2$).

Both materials used the same size coat formulation which comprised 80% of a phenolic resin formulation and 20% of a calcium carbonate filler, both proportions being by weight. The size coat was applied at a rate of 3 lb/ream, (44.48 g/m$^2$).

The difference lay in the addition of 8.8% by weight of graphite to the size coat. This addition rendered dielectric heating significantly more effective.

Both samples were taken from a commercial production run after application and partial curing of the size coat. The processes compared are therefore the different techniques for completing the cure of the binder resins which is normally done in jumbo rolls. Each of Samples #1 and #2 was divided into two sub-samples: 1TC and 1DC; and 2TC and 2DC. The subsamples labelled TC were thermally cured in a conventional way and those labelled DC were dielectrically cured.

Thermal Cure

Samples that were thermally cured were placed in an oven held at 120° C. for a period of two hours. The samples were in the form of one foot wide strips rather than rolls to accelerate the cure process.

Dielectric Cure

The subsamples that were dielectrically cured were passed between staggered upper and lower rows of electrodes which had a vertical distance between the rows of 2.54 cm. The rows of electrodes were contained within an Applicator that was 4 ft, (1.22 m), long by 1.5 ft, (45.7 cm), wide and the space within the Applicator was maintained at about 60° C. using auxiliary air heating. The frequency applied across the electrodes was 40 MHz and a 20kw output was used. The current delivered to the Applicator was about 1–2 amps. Subsample #1DC was moved backward and forward between the electrodes for 3 minutes at 1.2–1.3 amps. Subsample #2DC, (which contained the graphite), received only two minutes of the same treatment.

The four subsamples were analyzed using differential scanning calorimetry and were all found to have been fully cured under the above conditions.

The cured samples were then made into abrasive discs and were subjected to the Schiefer Test in which 4.5 inch (11.4 cm) diameter discs are used to grind the end of a 2.54 cm diameter aluminum pipe. The discs were evaluated based on the weight loss of the disc after standard period of grinding. The higher the weight loss, the less effectively the grain is held by the binder resin. The results obtained were as follows:

Subsample #1TC . . . 0.12 g Subsample #2TC . . . 0.32 g

Subsample #1DC . . . 0.19 g Subsample #2DC . . . 0.37 g

From this data it can be seen that the dielectric cure gave a product that was comparable to that produced by the traditional thermal cure but in 2–3 minutes as opposed to 2 hours. This represents a tremendous advantage when translated to a commercial environment. It should also be observed that full cure in the Subsample #2DC was obtained in only two thirds the time taken for the subsample without the graphite addition to fully cure.

While this demonstration relates to the post-curing process, it is quite clear that it could be readily adapted to other aspects of the production process for coated abrasives in which the binder used is adapted to be cured by radiofrequency heating.

What is claimed is:

1. A process for the production of a coated abrasive comprising a backing material and abrasive grits secured to the backing material using one or more coatings of a thermosettable binder resin formulation in which at least one of the binder resin coatings is at least partly cured by means of dielectric heating.

2. A process according to claim 1 in which the thermosettable resin is a phenolic resin.

3. A process according to claim 1 in which both maker and size coats are a thermosettable binder resin formulation.

4. A process according to claim 1 in which the binder formulation comprises a dielectric filler with an E" factor of at least 2.

5. A process according to claim 4 in which the dielectric filler comprises from about 1 to about 70% by weight of the binder resin formulation to which it is added.

6. A process according to claim 4 in which the dielectric filler is a finely divided powder.

7. A process according to claim 4 in which the dielectric filler is selected from the group consisting of barium titanate, carbon black, graphite, magnetite, ferric oxide and quaternary ammonium salts.

8. A process according to claim 1, in which dielectric heating completes the cure of a binder resin.

9. A process according to claim 8 in which the binder resin is a water based formulation and is dielectrically heated after the water has been essentially completely removed by directed air, high efficiency driers.

10. A process according to claim 9 in which the resin binder formulation comprises a dielectric filler with an E" factor of at least 2.

* * * * *